US008899312B2

(12) United States Patent
Bader

(10) Patent No.: US 8,899,312 B2
(45) Date of Patent: Dec. 2, 2014

(54) PLATE HEAT EXCHANGER

(75) Inventor: Roger Bader, Hisings Backa (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 13/982,981

(22) PCT Filed: Jan. 13, 2012

(86) PCT No.: PCT/SE2012/050025

§ 371 (c)(1),
(2), (4) Date: Jul. 31, 2013

(87) PCT Pub. No.: WO2012/105888

PCT Pub. Date: Aug. 9, 2012

(65) Prior Publication Data

US 2013/0306283 A1 Nov. 21, 2013

(30) Foreign Application Priority Data

Feb. 4, 2011 (SE) ..... 1150080

(51) Int. Cl.

| | |
|---|---|
| ***F28D 9/02*** | (2006.01) |
| ***F28F 27/02*** | (2006.01) |
| ***F28D 9/00*** | (2006.01) |
| ***F28F 3/08*** | (2006.01) |
| *F28F 9/02* | (2006.01) |

(52) U.S. Cl.

CPC . *F28F 3/08* (2013.01); *F28F 27/02* (2013.01); *F28F 9/028* (2013.01); *F28D 9/005* (2013.01); *F28F 9/026* (2013.01)

USPC ..... 165/300; 165/76; 165/103; 165/167

(58) Field of Classification Search

CPC ..... F28D 9/0037; F28D 9/0043; F28D 9/005; F28F 3/08; F28F 3/86; F28F 27/02; F28F 2250/06

USPC ..... 165/166, 167, 76

See application file for complete search history.

(56) References Cited

U.S. PATENT DOCUMENTS

| | | | |
|---|---|---|---|
| 3,743,011 | A | 7/1973 | Frost |
| 7,032,654 | B2 | 4/2006 | Wand et al. |
| 2008/0210410 | A1 | 9/2008 | Kalbacker et al. |

FOREIGN PATENT DOCUMENTS

| | | | |
|---|---|---|---|
| CN | 1656352 | A | 8/2005 |
| DE | 3020557 | A1 | 12/1981 |

(Continued)

OTHER PUBLICATIONS

International-Type Search Report issued on Jul. 20, 2011 issued by Swedish Patent Office in corresponding Swedish Patent Application No. 115080-8.

(Continued)

*Primary Examiner* — Allen Flanigan

(74) *Attorney, Agent, or Firm* — Buchanan Ingersoll & Rooney

(57) ABSTRACT

A plate heat exchanger comprises a plurality of heat exchanger plates provided beside each other to form a plate package with first plate interspaces for a first medium and second plate interspaces for a second medium. The first and second plate interspaces are provided in an alternating order in the plate package. A number of portholes extend through the plate package and form first inlet and outlet channels arranged to convey the first medium into and out from the first plate interspaces. An insert element is provided in one of the portholes for the first medium. The insert element comprises an annular body, an annular flange, projecting from the annular body and provided between two of the heat exchanger plates in the plate package.

13 Claims, 3 Drawing Sheets

(56) References Cited

FOREIGN PATENT DOCUMENTS

| | | | |
|---|---|---|---|
| DE | 197 12 599 | A1 | 10/1998 |
| EP | 0 608 195 | A1 | 7/1994 |
| EP | 1052468 | A2 | 11/2000 |
| EP | 1 850 082 | A1 | 10/2007 |
| GB | 654 395 | A | 6/1951 |
| JP | 2008-302415 | A | 12/2008 |
| RU | 2 320 946 | C2 | 8/2004 |
| RU | 2260757 | C2 | 9/2005 |
| SE | 515485 | C2 | 8/2001 |
| WO | 01/42729 | A1 | 6/2001 |
| WO | 03/100338 | A1 | 12/2003 |
| WO | WO 2006/126931 | A1 | 11/2006 |

OTHER PUBLICATIONS

Written Opinion (PCT/ISA/237) issued on Aug. 15, 2013 by European Patent Office as the International Searching Authority for International Patent Application No. PCT/SE2012/050025.

International Search Report (PCT/ISA/210) issued on May 14, 2012, by the Swedish Patent Office as the International Searching Authority for International Application No. PCT/SE2012/050025.

Office Action issued on Feb. 20, 2014, by the Taiwanese Patent Office in corresponding Taiwanese Patent Application No. 101101564 and an English Translation of the Office Action. (8 pages).

Russian Office Action issued on Oct. 1, 2014, by the Russian Patent Office, in corresponding Russian Patent Application No. 2013140684 (3 pages).

PLATE HEAT EXCHANGER

THE FIELD OF THE INVENTION

The present invention refers to a plate heat exchanger.

EP-B-608 195 discloses such a plate heat exchanger comprising a plurality of heat exchanger plates provided beside each other to form a plate package having first plate interspaces for a first medium and second plate interspaces for a second medium. The first and second plate interspaces are provided in an alternating order in the plate package. A number of portholes extend through the plate package and form first inlet and outlet channels arranged to convey the first medium into and out from the first plate interspaces. An immersion tube is provided in one of the portholes, in which a temperature sensor extends.

In many heat exchanger applications, there is a need of providing various insert elements in any of the portholes of a plate heat exchanger. Such insert elements may be required for holding different kinds of functional devices, for instance a temperature sensor as disclosed in EP-B-608 195. A problem in this context is the difficulty to attach the insert element in a secure and efficient manner in the porthole.

SUMMARY OF THE INVENTION

The object of the present invention is to provide a reliable and efficient attachment of an insert element in a porthole of a plate heat exchanger.

This object is achieved by the plate heat exchanger initially defined, which is characterized in that the first side comprises an annular groove in the proximity of the annular body and at least one radial groove extending from the annular groove to an outer edge of the annular flange.

Such an annular flange may in an easy and secure manner be positioned in a porthole, by being disposed between the two heat exchanger plates in connection with the mounting of the plate heat exchanger. When the heat exchanger plates then are tightened against each other or joined through melting of metallic material, the position of the flange, and thus the insert element, will be fixed in the porthole.

According to an embodiment of the invention, the insert element is arranged to position a functional device in said porthole. Advantageously, the functional device may comprise or consist of a flow guiding device and/or a sensing device. Thanks to the insert element, the desired functional device may be positioned in a desired position in the porthole.

According to an embodiment of the invention, the annular body comprises an attachment member arranged to attach and hold the functional device in said porthole. The attachment member may be designed for permanent attachment of the functional device in the insert element. The attachment member may alternatively be designed for releasable attachment of the functional device in the insert element. Advantageously, the functional device may be attached in the attachment member of the insert element before the insert element is mounted in the plate heat exchanger.

According to an embodiment of the invention, the attachment member comprises a thread arranged to co-act with a corresponding thread of the functional device, wherein these threads form a thread joint. Advantageously, the attachment member may comprise an inner thread which is arranged to co-act with a corresponding outer thread of the functional device. With such a thread joint, the functional device may be attached in an easy and releasable manner in the insert element.

According to an embodiment of the invention, the attachment member comprises a first bayonet coupling part arranged to co-act with a corresponding second bayonet coupling part of the functional device, wherein these parts form a bayonet coupling. With such a bayonet coupling, the functional device may be attached in an easy and releasable manner in the insert element.

According to an embodiment of the invention, the attachment member comprises a surface arranged to co-act with a corresponding surface of the functional device, wherein these surfaces form a press fit. The functional device may thus be held with a press force in the insert element by the two surfaces being pressed against each other. The functional device may according to this embodiment also be attached by shrinking in the insert element.

According to an embodiment of the invention, the functional device comprises a flow guiding device. Advantageously, the plate heat exchanger may be divided into a first heat exchanger part, which comprises a group of heat exchanger plates lying between each other, and a second heat exchanger part, which comprises another group of heat exchanger plates lying beside each other, wherein the insert element is provided between the first heat exchanger part and the second heat exchanger part and arranged to guide the first medium to be conveyed in a direction through the first plate interspaces in the first heat exchanger part and in an opposite direction through the first plate interspaces in the second heat exchanger part.

According to an embodiment of the invention, the flow guiding device comprises a valve arranged to throttle said at least one porthole to prevent the first medium at least partly from passing through said at least one porthole. In plate heat exchangers for cooling of oil there is a need of being able to convey at least a part of the oil straight through the porthole when the temperature of the oil is low and the need of cooling thus small. If all oil is conveyed through the heat exchanger a relatively high pressure drop is obtained, and this may be avoided by such a valve through which the oil is conveyed by passing at least a part of the plate interspaces. Advantageously said valve may be a thermostat valve arranged to throttle said porthole in response to the temperature of the first medium.

According to an embodiment of the invention, the first side and the second side are parallel with each other.

According to an embodiment of the invention, the heat exchanger plates and the insert element are permanently connected to each other through melting of a metallic material, for instance by brazing wherein the first side is permanently connected to one of said two heat exchanger plates and the second side is permanently connected to the other of said two heat exchanger plates.

According to an embodiment of the invention, the annular groove and said radial groove may have such a depth that the metallic material after melting does not fill out the grooves.

According to an embodiment of the invention, the second side is even.

According to an embodiment of the invention, said portholes also form second inlet and outlet channels arranged to convey the second medium into and out from the second plate interspaces.

BRIEF DESCRIPTION OF THE DRAWINGS

The present invention is now to be explained more closely through a description of various embodiments and with reference to the drawings attached hereto.

DETAILED DESCRIPTION OF VARIOUS EMBODIMENTS OF THE INVENTION

Figure 1:
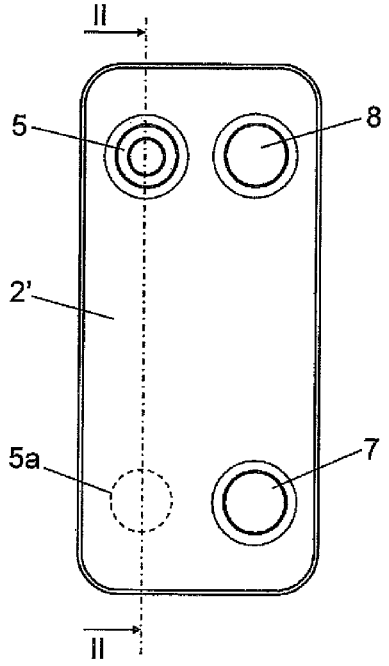
FIG. 1 discloses schematically a front view of a plate heat exchanger according to the invention with an insert element having a first variant of a functional device.
Figure 2:
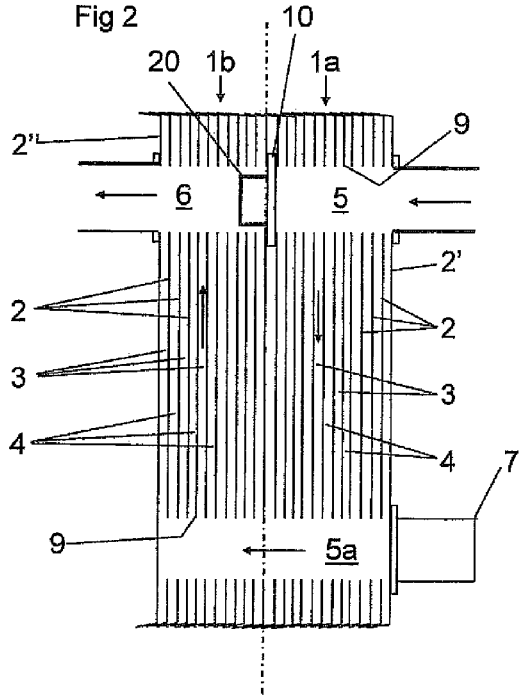
FIG. 2 discloses schematically a sectional view along the line II-II in FIG. 1.

FIGS. 1 and 2 disclose a plate heat exchanger comprising a plate package 1 having a plurality of heat exchanger plates 2, which are compression-moulded in a manner known per se and comprise a heat transfer surface, preferably with a compression-moulded corrugation of ridges and valleys (not shown), and a surrounding edge flange, which in the embodiments disclosed is bent. The two outer heat exchanger plates 2', 2" form end plates of the plate package 1. The two outer heat exchanger plates 2', 2" may have another design than the remaining heat exchanger plates 2 with respect to for instance the thickness and/or the corrugation. They may for instance be even or substantially even. It is also possible to provide the two outer heat exchanger plates 2', 2" tightly against the respective nearest heat exchanger plate 2 so that there is no plate interspace between the outer heat exchanger plate 2', 2" and the nearest heat exchanger plate 2.

The heat exchanger plates 2 are provided beside each other in the plate package 1 to form first plate interspaces 3 for a first medium and second plate interspaces 4 for a second medium. The first and second plate interspaces 3 and 4 are provided in an alternating order in the plate package 1, i.e. every second plate interspace is a first plate interspace 3 and every second plate interspace is a second plate interspace 4, see FIG. 2.

The plate heat exchanger comprises the number of portholes extending through the plate package 1. The portholes form a first inlet channel 5 for conveying the first medium into the first plate interspaces 3 and a first outlet channel 6 for conveying the first medium out from the first plate interspaces 3. The portholes also form a second inlet channel for conveying the second medium into the second plate interspaces 4 and a second outlet channel for conveying the second medium out of the second interspaces 3. It is possible to dispense with for instance the porthole forming the second inlet and outlet channels 7, 8, and to provide the inlet and outlet of the second plate interspaces 4 via the sides of the plate package 1.

Figure 3:
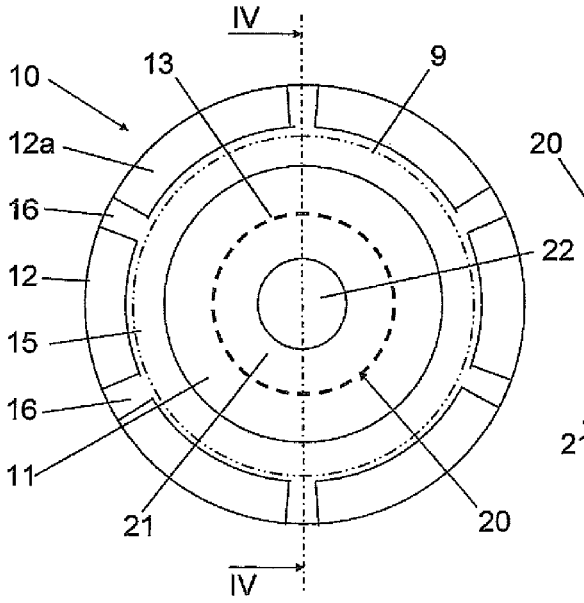
FIG. 3 discloses schematically a front view of the insert element of the plate heat exchanger in FIGS. 1 and 2.

The inlet and outlet channels 5-8 are formed by a respective port opening 9, see FIG. 3, of each of the heat exchanger plates 2, possibly except for one or both of the outer heat exchanger plates 2', 2" as can be seen more closely below.

The plate heat exchanger may be used for all kinds of media. One example of an application field is as oil cooler, wherein the first medium is the oil to be cooled and the second medium is a cooling medium, for instance water. It is to be noted that the plate heat exchanger may be used in other applications, such as in a local heating network, or in a district heating network, for instance for heating of tap water, in heat pump plants, in industrial processes, for cooling and/or heating in vehicles, etc.

In the embodiments disclosed, the heat exchanger plates 2, 2', 2" are permanently connected to each other through for instance brazing, glueing or welding. However, it is to be noted that the invention also is applicable to plate heat exchangers which are kept together in another way, such as by means of tie bolts.

The plate heat exchanger also comprises an insert element 10, which is provided in one of the portholes for the first medium. The purpose of the insert element 10 is to position a functional device 20 in this porthole. The functional device 20 provides a further function or an additional function to the plate heat exchanger. The additional function may be active, for instance a flow guiding function, and/or passive, for instance a sensing function.

The insert element 10 comprises an annular body 11 and an annular flange 12, which projects outwardly from the annular body 11. The annular body 11 and the annular flange 12 are in the embodiments disclosed designed in one piece. These two elements may however also be two separate parts which are mounted to the insert element 10.

Figure 4:
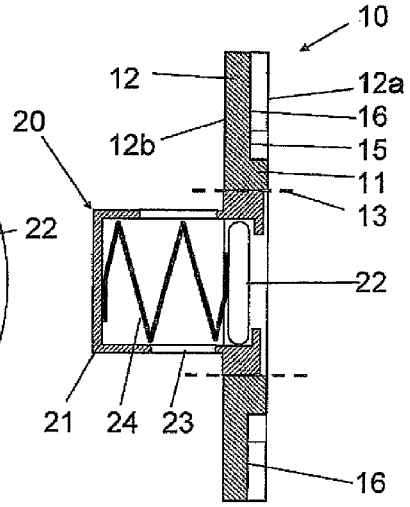
FIG. 4 discloses schematically a sectional view along the line IV-IV in FIG. 3.
Figure 5:
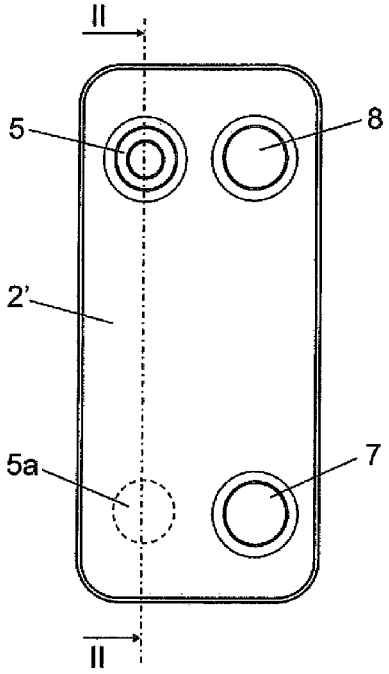
FIG. 5 discloses schematically a front view of a plate heat exchanger according to the invention with an insert element having a second variant of a functional device.

The annular body 10 comprises an attachment member arranged to attach and hold the functional device 20 in the porthole. In the embodiments disclosed in FIGS. 1-4, the attachment member comprises a thread which is arranged to co-act with a corresponding thread of the functional device. The thread of the attachment member is arranged to form, together with this corresponding thread, a thread joint 13 which is indicated schematically in FIGS. 3 and 4.

The annular flange 12 of the insert element is provided between two of the heat exchanger plates 2 in the plate package 1. In the embodiments disclosed, the annular flange 12 is located, at least partly, in one of the first plate interspaces 3. The annular flange 12 has a first side 12*a* and a corresponding second side 12*b*, which abut a respective one of the two heat exchanger plates 2 which enclose the first plate interspace 3 concerned.

The insert element 10 is in the embodiments disclosed permanently connected to the two adjacent heat exchanger plates 2. The first side 12*a* is then permanently connected to one of the two heat exchanger plates 2 and the second side 12*b* is permanently connected to the other of the two heat exchanger plates 2. The permanent connection may be achieved in connection with the mounting of the plate heat exchanger and the components are connected to each other by the above mentioned melting of a metallic material. If the plate heat exchanger instead is kept together by means of tie bolts, the insert element may be held by clamping the annular flange 12 between the two adjacent heat exchanger plates 2.

The functional device 20 may advantageously be attached in the insert element 10 before this is mounted to the heat exchanger plates 2. However, it is possible to mount the functional device 20 in the insert element 10 when this is already mounted in the plate heat exchanger. The disclosed embodiments also permit the functional device 20 to be replaceable without demounting of the plate heat exchanger or removal of the insert element 10 from the position in the porthole.

As can be seen in especially FIGS. 5, 3, 7 and 11, the first side 12*a* of the annular flange 12 comprises an annular groove 15 in the proximity of the annular body 11, and six radial grooves 16 extending outwardly from the annular groove 15 to an outer edge of the annular flange 12. The annular groove 15 is provided in such a way, or at such a radius in relation to a centre axis through the insert element 10, that the groove 15 is located completely or partly in the port opening, whereas the radial grooves 16 may be provided so that they are located outside the port opening 9 between the heat exchanger plates 2, see FIG. 3. The grooves 15 and 16 may have the same depth. More or less then six radial grooves 16 may extend from the annular groove 15. The second side 12*b* of the annular flange 12 is in the embodiments disclosed even.

In the embodiments disclosed in FIG. 1-4, the functional device 20 comprises a flow guiding device. The plate heat exchanger is here divided into a first heat exchanger part 1*a* and a second heat exchanger part 1*b*. The insert element 10 is provided between the first heat exchanger part 1*a* and the second heat exchanger part 1*b*, and forms a limit or a separation device between the first exchanger part 1*a* and the second heat exchanger part 1*b*. The insert element 10 is arranged to guide the first medium so that it is conveyed in a direction through the first plate interspaces 3 in the first heat exchanger part 1*a*, and in an opposite direction through the first plate interspaces 3 in the second heat exchanger part 1*b*.

Figure 6:
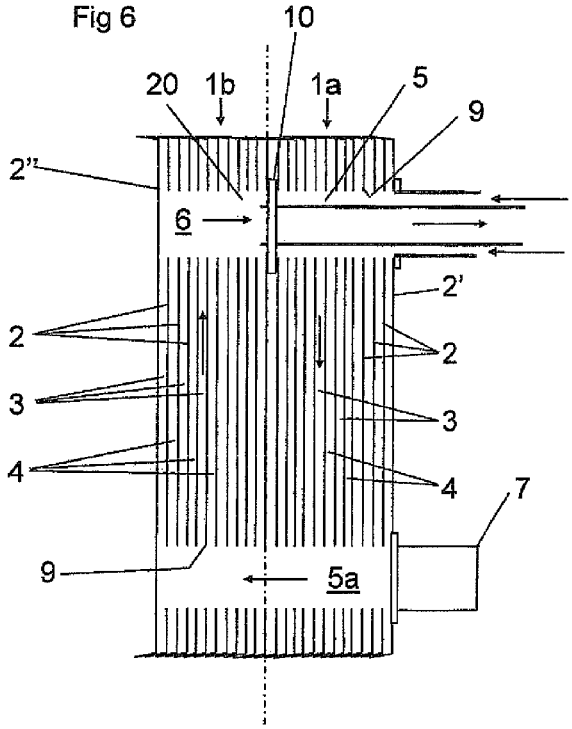
FIG. 6 discloses schematically a sectional view along the line VI-VI in FIG. 5.
Figure 7:
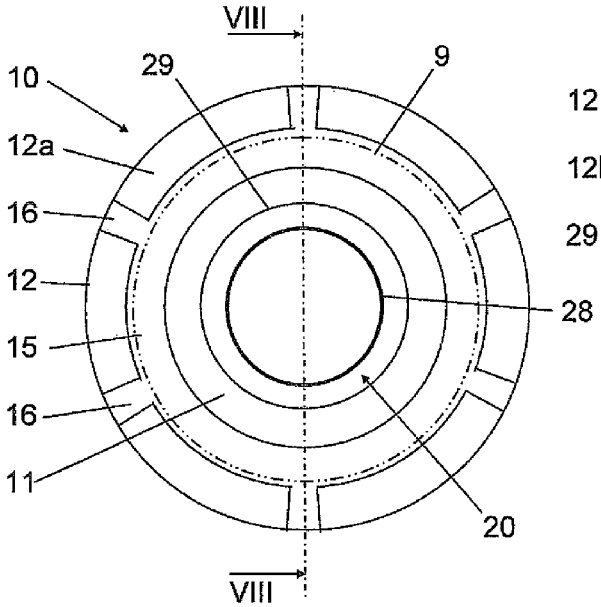
FIG. 7 discloses schematically a front view of the insert element of the plate heat exchanger in FIGS. 5 and 6.
Figure 8:
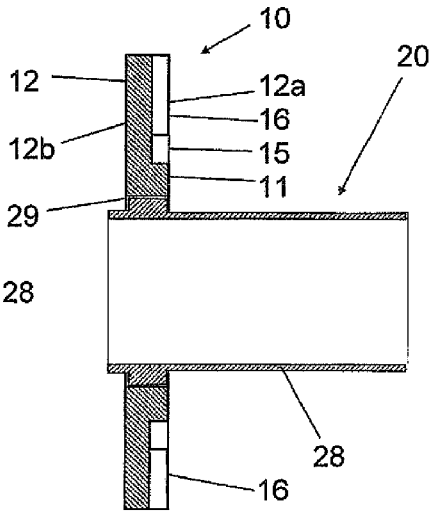
FIG. 8 discloses schematically a sectional view along the line VIII-VIII in FIG. 7.

The first inlet channel 5 and the first outlet channel 6 will thus be located in same porthole, wherein the inlet channel extends from one side of the plate heat exchanger through the first outer heat exchanger plate 2' and the heat exchanger plates 2 of the first heat exchanger part 1*a* up to the insert element 10. The first outlet channel 6 extends from the insert element 10 through the heat exchanger plates 2 of the second heat exchanger part 1*b*, the second outer heat exchanger plate 2" and out through the second side of the plate heat exchanger. The portholes also form a first internal channel 5*a* connecting the first plate interspaces 3 in the first heat exchanger part 1*a* with the first plate interspaces 3 in the second heat exchanger part 1*b*. The first internal channel 5*a* extends through all heat exchanger plates 2 except for the two outer heat exchanger plates 2' and 2", which can be seen in FIGS. 2 and 6.

The first medium which is conveyed into the first inlet channel 5 and reaches the insert element 10 will thus be conveyed into the annular groove 15 and from there further to and out from the radial grooves 16. This means that the first medium will be conveyed into the first plate interspace 3 in which the annular flange 12 of the insert element 10 is located. In such a way it is ensured that no one of the plate interspaces 3, 4 will be blocked by the insert element 10.

In the embodiments disclosed in FIG. 1-4, the functional device 20 comprises a valve 21 which is arranged to throttle one of the portholes, in the embodiments disclosed the first inlet channel 5, so that the first medium is prevented, at least partly, from passing through this porthole. The valve 21 may have a suitable design and a schematic example is disclosed in FIG. 4. The valve 21 may in this example comprise a valve body 22 which may open or close a valve opening 23. A spring 24 acts on the valve body 22 and presses this towards the closed position disclosed in FIG. 4. The valve 20 may be a thermostat valve which is arranged to throttle the porthole depending on the temperature of the first medium. Such a thermostat valve may be realised by a spring 24 which is temperature sensitive and in the example compressed to the opened position when the temperature of the first medium sinks below a determined level. The spring 24 may be manufactured of bimetal or memory metal.

With such a valve, the first medium may thus be conveyed through the first heat exchanger part 1*a* and thereafter through the second heat exchanger part 1*b* when the temperature of the first medium exceeds a certain level, and there is a need of cooling of the first medium, by closing the valve 20. If the temperature of the first medium sinks below a determined level, the valve 21 opens and the first medium may be conveyed directly from the first inlet channel 5 to the first outlet channel 6 without passing through the first plate interspaces 3.

The embodiment which is disclosed in FIGS. 5-8 differs from the one in FIGS. 1-4 in that the functional device 20 is designed as a flow pipe 28. This flow pipe 28 is attached in the insert element 10 by means of an attachment member in form of a press fit 29, i.e. the annular body 11 of the insert element 10 has an inner circular, or possibly conical surface, which co-acts with a corresponding outer circular, or possibly conical, surface of the flow pipe 28. The surfaces are pressed against each other so that the flow pipe 28 is securely held in the insert element 10. It is to be noted that also in this embodiment disclosed in FIGS. 5-8, the attachment member may comprise a thread joint.

The flow pipe 28 is thus positioned in the porthole of the first inlet channel 5. The first medium flows into the first inlet channel 5 outside the flow pipe 28 and into the first plate interspaces 3 in the first heat exchanger part 1*a*, i.e. those located upstream the insert element 10. The first medium then flows through the first plate interspaces 3 of the second heat exchanger part 1*b* to the first outlet channel 6 and are then conveyed out from the plate heat exchanger through the insert element 10 and the flow pipe 28. In this embodiment, a port opening 9 is missing in the outer heat exchanger plate 2" in the prolongation of the first inlet channel 5.

Figure 9:
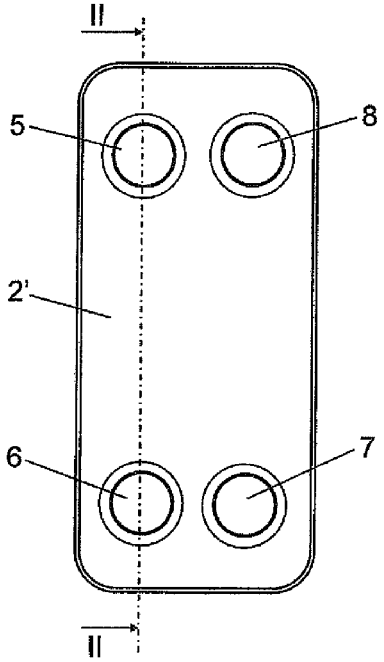
FIG. 9 discloses schematically a front view of a plate heat exchanger according to the invention with an insert element having a third variant of a functional device.
Figure 10:
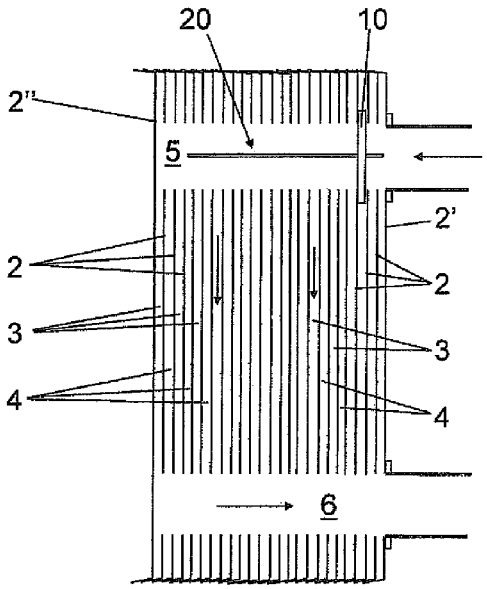
FIG. 10 discloses schematically a sectional view along the line X-X in FIG. 9.
Figure 11:
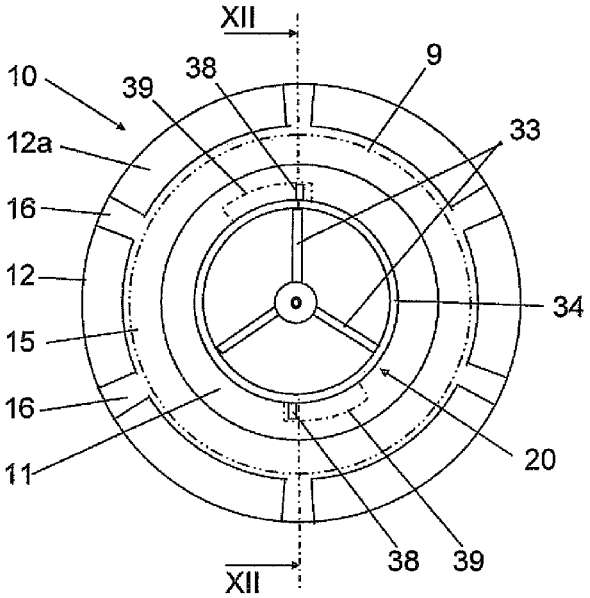
FIG. 11 discloses schematically a front view of the insert element of the plate heat exchanger in FIGS. 9 and 10.
Figure 12:
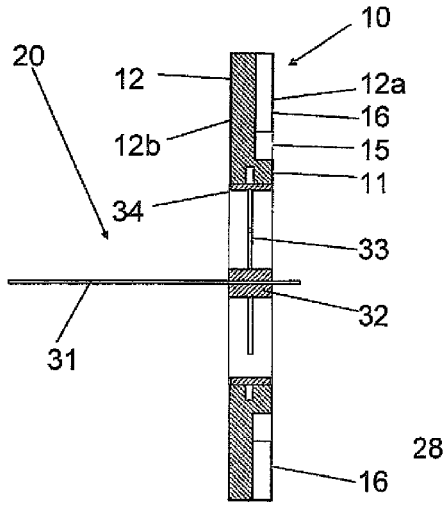
FIG. 12 discloses schematically a sectional view along the line XII-XII in FIG. 11.

The embodiments disclosed in FIGS. 9-11 differ from the embodiments disclosed in FIGS. 1-8 in that the functional device 20 does not comprise any flow guiding device but a passive, sensing device. In the embodiments disclosed, the functional device 20 comprises a temperature sensor 31 which is arranged to sense the temperature of the first medium. The sensed temperature may be used for controlling a valve 32 which controls the flow through the second plate interspaces 4. The temperature sensor 31 is held in the insert element 10 by means of a hub 32 which in turn is held by means of a suitable number, for instance three, spikes 33 which each is connected to a ring 34. With this embodiment, the insert element 10 is opened, i.e. the first medium may flow straight through the insert element 10.

In the embodiment disclosed in FIGS. 9-11, the attachment member comprises a bayonet coupling 37 having a first bayonet coupling part 38, which for instance comprises two pins of the functional device 20 and is arranged to co-act with a corresponding second bayonet coupling part 39, which for instance comprises two grooves in the annular body 11. In the embodiment disclosed, the pins projects from the ring 34. It is to be noted that in the embodiment disclosed in FIGS. 9-11, the attachment member may alternatively comprise a thread joint 13 or a press fit 29. The outer heat exchanger plate 2" is in this embodiment complete, i.e. it lacks portholes.

The invention is not limited to the embodiments disclosed but may be varied and modified within the scope of the following claims.

The invention claimed is:

1. A plate heat exchanger comprising a plurality of heat exchanger plates provided beside each other to form a plate package having first plate interspaces for a first medium and second plate interspaces for a second medium, wherein the first and second plate interspaces are provided in an alternating order in the plate package, a number of portholes extending through the plate package and forming first inlet and outlet channels arranged to convey the first medium into and out from the first plate interspaces, an insert element, which is provided in one of the portholes for the first medium, and comprises an annular body and an annular flange projecting outwardly from the annular body and provided between two of the heat exchanger plates in the plate package, wherein the annular flange has a first side and an opposite second side, which abut a respective one of the two heat exchanger plates, wherein the first side comprises an annular groove in the proximity of the annular body and at least one radial groove extending from the annular groove to an outer edge of the annular flange.

2. A plate heat exchanger according to claim 1, wherein the insert element is arranged to position a functional device in said porthole.

3. A plate heat exchanger according to claim 2, wherein the insert element comprises an attachment member arranged to attach and hold the functional device in said porthole.

4. A plate heat exchanger according to claim 3, wherein the attachment member comprises a thread arranged to co-act with a corresponding thread of the functional device and wherein these threads form a thread joint.

5. A plate heat exchanger according to claim 3, wherein the attachment member comprises a first bayonet coupling part arranged to co-act with a corresponding second bayonet coupling part of the functional device and wherein these parts form a bayonet coupling.

6. A plate heat exchanger according to claim 3, wherein the attachment member comprises a surface arranged to co-act with a corresponding surface of the functional device and wherein these surfaces form a press fit.

7. A plate heat exchanger according to claim 2, wherein the functional device comprises a flow guiding device.

8. A plate heat exchanger according to claim 7, wherein the plate heat exchanger is divided into a first heat exchanger part and a second heat exchanger part, and wherein the insert element is provided between the first heat exchanger part and the second heat exchanger part and arranged to guide the first medium to be conveyed in a direction through the first plate interspaces in the first heat exchanger part and in an opposite direction through the first plate interspaces in the second heat exchanger part.

9. A plate heat exchanger according to claim 8, wherein the functional device comprises a valve arranged to throttle said at least one porthole to prevent the first medium at least partly from passing through said at least one porthole.

10. A plate heat exchanger according to claim 9, wherein said valve comprises a thermostat valve arranged to throttle said porthole in response to the temperature of the first medium.

11. A plate heat exchanger according to claim 1, wherein the heat exchanger plates and the insert element are permanently connected to each other through melting of a metallic material and wherein the first side is permanently connected to one of said two heat exchanger plates and the second side is permanently connected to the other of said two heat exchanger plates.

12. A plate heat exchanger according to claim 1, wherein the second side is even.

13. A plate heat exchanger according to claim 1, wherein said portholes also form second inlet and outlet channels arranged to convey the second medium into and out from the second plate interspaces.

* * * * *